US011781561B2

(12) United States Patent
Lee et al.

(10) Patent No.: US 11,781,561 B2
(45) Date of Patent: Oct. 10, 2023

(54) COMPRESSOR AND CHILLER INCLUDING THE SAME

(71) Applicant: LG ELECTRONICS INC., Seoul (KR)

(72) Inventors: Heewoong Lee, Seoul (KR); Jinhee Jeong, Seoul (KR); Hyunwook Han, Seoul (KR); Uisik Hwang, Seoul (KR); Jungho Kang, Seoul (KR); Cheolmin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 182 days.

(21) Appl. No.: 17/230,086

(22) Filed: Apr. 14, 2021

(65) Prior Publication Data

US 2021/0324876 A1 Oct. 21, 2021

(30) Foreign Application Priority Data

Apr. 21, 2020 (KR) ..... 10-2020-0047943

(51) Int. Cl.
*F04D 29/44* (2006.01)
*F04D 29/42* (2006.01)
*F25B 31/02* (2006.01)

(52) U.S. Cl.
CPC ..... *F04D 29/444* (2013.01); *F04D 29/4213* (2013.01); *F25B 31/026* (2013.01); *F25B 2400/07* (2013.01); *F25B 2400/13* (2013.01)

(58) Field of Classification Search
CPC ..... F04D 17/06; F04D 17/12; F04D 17/122; F04D 17/165; F04D 29/441;
(Continued)

(56) References Cited

U.S. PATENT DOCUMENTS 4,902,200 A * 2/1990 Bandukwalla ..... F04D 29/464 415/157
5,228,832 A * 7/1993 Nishida ..... F04D 17/06 415/208.1
(Continued)

FOREIGN PATENT DOCUMENTS

CN 104595247 5/2015
CN 105257574 1/2016
(Continued)

OTHER PUBLICATIONS

Chinese Office Action issued in Application No. 202110426014.X dated Mar. 21, 2023.

*Primary Examiner* — Topaz L. Elliott
*Assistant Examiner* — Michael K. Reitz
(74) *Attorney, Agent, or Firm* — KED & ASSOCIATES

(57) ABSTRACT

The present disclosure relates to a compressor including: a motor having a rotating shaft; a first impeller housing forming a first inlet, through which a first refrigerant flows, and having a chamber into which a second refrigerant flows; a first impeller coupled to one end of the rotating shaft, and rotatably received in the first impeller housing; a diffuser spaced apart from an inside of the first impeller housing, and forming a first outlet; a second impeller housing having a second inlet formed therein; a second impeller coupled to the other end of the rotating shaft, and rotatably received in the second impeller housing; a volute case in which a volute is formed; and a motor housing having a connecting passage formed therein and connecting the first outlet and the second inlet.

18 Claims, 9 Drawing Sheets

(58) Field of Classification Search
CPC ..... F04D 29/4206; F04D 29/4213; F04D 29/4253; F04D 1/02; F04D 1/06; F04D 13/02; F25B 31/026
See application file for complete search history.

(56) References Cited

U.S. PATENT DOCUMENTS

| | | | | |
|---|---|---|---|---|
| 10,544,799 | B2 * | 1/2020 | Jiang | F04D 29/667 |
| 2010/0287958 | A1 * | 11/2010 | Telakowski | F04D 29/5806 62/56 |
| 2015/0107289 | A1 * | 4/2015 | Sun | F04D 29/048 417/244 |
| 2016/0123639 | A1 * | 5/2016 | Koga | F25B 1/10 62/503 |
| 2022/0228593 | A1 * | 7/2022 | Joly | F04D 25/02 |
| 2022/0333602 | A1 * | 10/2022 | Iancu | F04D 17/122 |

FOREIGN PATENT DOCUMENTS

| | | |
|---|---|---|
| CN | 107165869 | 9/2017 |
| JP | 2009-186033 | 8/2009 |

* cited by examiner

COMPRESSOR AND CHILLER INCLUDING THE SAME

CROSS-REFERENCE TO RELATED APPLICATION(S)

This application claims the priority benefit of Korean Patent Application No. 10-2020-0047943, filed in Korea on Apr. 21, 2020 in the Korean Intellectual Property Office, the disclosure of which is incorporated herein by reference.

BACKGROUND OF THE INVENTION

1. Field of the Invention

The present disclosure relates to a compressor and a chiller including the same, and more particularly to a structure for efficiently flowing a refrigerant in a gaseous state, discharged from an economizer, into the compressor.

2. Description of the Related Art

Generally, a chiller supplies chilled water to demand sources of the chilled water, and provides cooling by heat exchange between a refrigerant, circulating through a refrigeration cycle, and chilled water circulating through the demand sources. As large-capacity cooling equipment, the chiller may be installed in large buildings and the like.

The chiller includes a compressor compressing a refrigerant, in which in order to improve efficiency of a single stage compressor using refrigerant "R134a," which is an eco-friendly HFC-based refrigerant, a multi-stage compressor may be used which forms a circuit for compressing the refrigerant in two or more stages.

FIG. 1 is a diagram illustrating a chiller 1 including a general two-stage compressor 2 as an example of a multi-stage compressor.

As illustrated in FIG. 1, the chiller 1 includes: a two-stage compressor 2 including a first compressor 10 and a second compressor 20 compressing a low-temperature and low-pressure refrigerant into a high-temperature and high-pressure refrigerant in two stages; a condenser 30 condensing the compressed high-temperature and high-pressure refrigerant into a liquid refrigerant; a first expander 40 and a second expander 50 decompressing the condensed liquid refrigerant in two stages and expanding the refrigerant; and an evaporator 60 evaporating a liquid flowing out of the second expander 50 to cool chilled water to be used by a demand source (e.g., indoor unit).

The chiller 1 having such two-stage compressor 2 may further include an economizer 70, unlike the single stage compressor. In addition, two economizers may be installed for a three-stage compression method, or three economizers may be installed for a four-stage compression method.

The economizer 70 serves to separate a refrigerant having a mixture of two phases (i.e., saturated liquid and saturated vapor), flowing out of a low-stage expander (e.g., the first expander 40 of FIG. 1) during an expansion process in a multi-stage refrigeration cycle, into a gaseous phase (i.e., saturated vapor) and a liquid phase (i.e., saturated liquid), and distributes the liquid refrigerant to a high-stage expander (e.g., the second expander 50 of FIG. 1) or the evaporator 60 and distributes the gaseous refrigerant to a high-stage compressor (e.g., the second compressor 20 of FIG. 1) for recompression.

By recovering the gaseous refrigerant (e.g., flash gas), generated by passing through the low-stage expander, to a high stage of the compressor, the economizer 70 may decrease a degree of dryness of the refrigerant flowing into the evaporator, and may increase evaporative latent heat for equal mass flow rate, thereby improving refrigeration efficiency. Further, the economizer 70 may improve compression efficiency by reducing a specific volume of the refrigerant by decreasing the inlet temperature of the high-stage compressor, by reducing a load on the high-stage compressor, and the like.

In this case, if the gaseous refrigerant, flowing from the economizer 70 into the second compressor 20, hinders the flow of a refrigerant having passed through the first compressor 10 in the two-stage compressor 2, compression efficiency of the two-stage compressor 2 may be reduced. Accordingly, the gaseous refrigerant, flowing from the economizer 70 into the second compressor 20, is required to flow in a manner that may minimize hindrance to a flow of the refrigerant having passed through the first compressor 10.

SUMMARY OF THE INVENTION

In order to solve the above problems, it is an object of the present disclosure to provide a compressor capable of minimizing hindrance to a flow, which is caused by a refrigerant flowing from an economizer to a front end of a two-stage impeller.

Further, it is another object of the present disclosure to provide a chiller including the compressor and the economizer.

The objects of the present disclosure are not limited to the aforementioned objects and other objects not described herein will be clearly understood by those skilled in the art from the following description.

In accordance with an aspect of the present disclosure, the above and other objects can be accomplished by providing a compressor, including: a motor having a rotating shaft; a first impeller housing forming a first inlet, through which a first refrigerant flows, and having a chamber into which a second refrigerant flows; a first impeller coupled to one end of the rotating shaft, and rotatably received in the first impeller housing; a diffuser spaced apart from an inside of the first impeller housing, and forming a first outlet; a second impeller housing having a second inlet formed therein; a second impeller coupled to the other end of the rotating shaft, and rotatably received in the second impeller housing; a volute case in which a volute is formed; and a motor housing having a connecting passage formed therein and connecting the first outlet and the second inlet.

In accordance with another aspect of the present disclosure, the above and other objects can be accomplished by providing a chiller, including: a compressor configured to compress a mixed refrigerant; a condenser configured to condense a refrigerant compressed by the compressor; a first expander configured to expand the condensed refrigerant; an economizer configured to separate the expanded refrigerant into a first refrigerant in a gaseous state and a second refrigerant in a liquid state, and to flow the first refrigerant into the compressor; a second expander configured to expand the second refrigerant; and an evaporator configured to evaporate the expanded second refrigerant.

The first impeller may be a mixed flow type impeller which suctions the first refrigerant in an axial direction and discharges the first refrigerant in a slope direction between the axial direction and a centrifugal direction.

The first impeller housing may have a first inner circumferential surface forming the first inlet and a receiving space of the first impeller, a second inner circumferential surface facing the diffuser, and an outer circumferential surface forming an exterior.

The chamber may be separated from the first inlet and the first impeller receiving space, between the first inner circumferential surface, the second inner circumferential surface, and the outer circumferential surface.

A maximum outer diameter of the chamber may be greater than an outer diameter of the connecting passage.

The first impeller housing may have an outer diameter and an inner diameter which increase in a flow direction of the first refrigerant.

A first impeller housing may further include: a second refrigerant inlet allowing a discharge tube of an economizer to communicate with the chamber so that the second refrigerant may flow into the chamber; and a second refrigerant outlet allowing the chamber to communicate with the first outlet.

The second refrigerant inlet may be connected to a front end of the chamber in a direction perpendicular to the rotating shaft.

The second refrigerant outlet may be connected to a rear end of the chamber in a direction parallel to the rotating shaft.

A distance between the rotating shaft to the second refrigerant outlet may be within a predetermined distance from a distance between the rotating shaft and the connecting passage.

The connecting passage may provide a passage through which a mixed refrigerant having a mixture of the first refrigerant and the second refrigerant passes, and may extend axially along an outer circumferential surface of the motor housing.

The diffuser may include: a flat surface portion having a hollow; an enlarging portion having an outer diameter which gradually increases in a flow direction of the first refrigerant from an edge of the flat surface portion; and a diffuser vane protruding outwardly from the enlarging portion.

The enlarging portion may be spaced apart from the second inner circumferential surface, so that the first outlet may be formed between the enlarging portion and the second inner circumferential surface.

A plurality of diffuser vanes may be formed while forming an acute angle with a slope direction of the enlarging portion, wherein the respective diffuser vanes may be spaced apart from each other at a predetermined interval in a circumferential direction.

A number of the diffuser vanes may be equal to a number of the second refrigerant outlets.

The second refrigerant outlets may be disposed at a distance equal to or greater than a distance from the rotating shaft to one end of the diffuser vanes in a radial direction; and may be disposed between the respective diffuser vanes in the circumferential direction.

The second impeller housing may have an inner diameter which gradually decreases in a flow direction of the mixed refrigerant having the mixture of the first refrigerant and the second refrigerant.

The second impeller may be a centrifugal impeller which suctions the mixed refrigerant in the axial direction and discharges the refrigerant in a centrifugal direction.

The volute case may form a second outlet, which is formed between the second impeller hosing and the volute case, and through which the mixed refrigerant discharged by the second impeller passes.

Other detailed matters of the exemplary embodiments are included in the detailed description and the drawings.

DETAILED DESCRIPTION OF THE PREFERRED EMBODIMENTS

Figure 1:
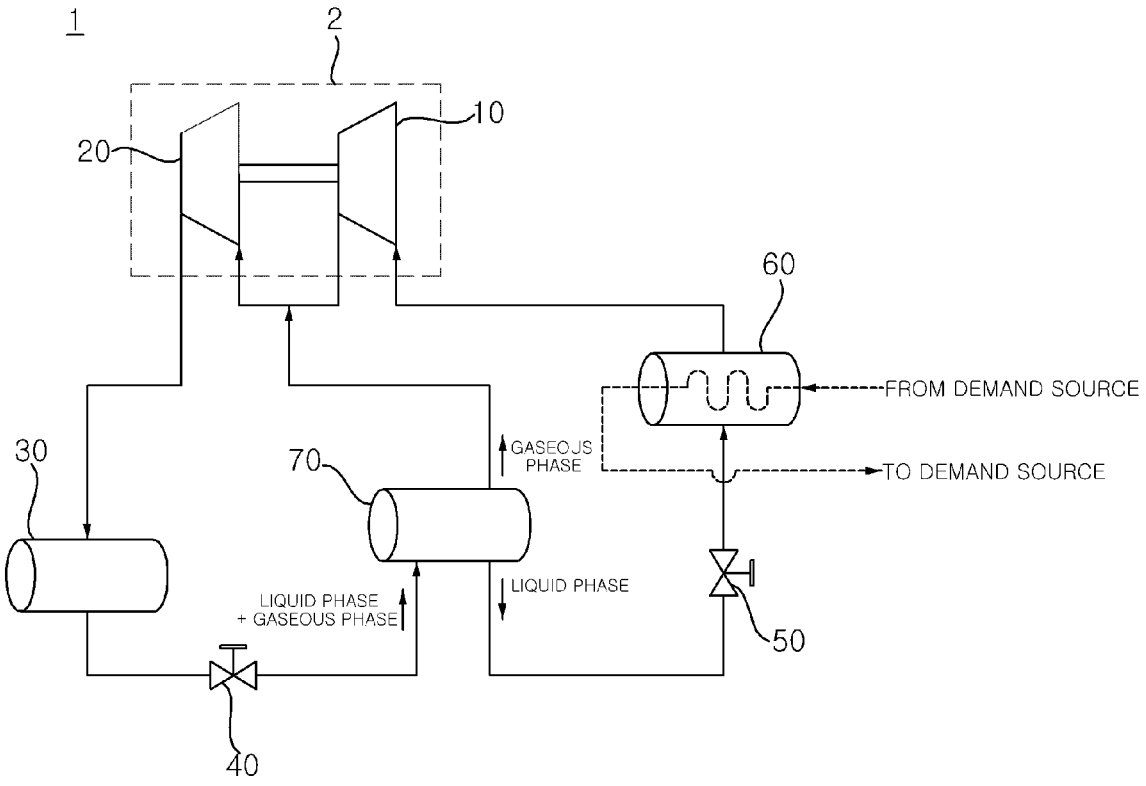
FIG. 1 is a systematic diagram of a chiller including a general two-stage compressor.

Advantages and features of the present invention and methods for achieving those of the present invention will become apparent upon referring to embodiments described later in detail with reference to the attached drawings. However, embodiments are not limited to the embodiments disclosed hereinafter and may be embodied in different ways. The embodiments are provided for perfection of disclosure and for informing persons skilled in this field of art of the scope of the present invention. The same reference numerals may refer to the same elements throughout the specification.

Spatially-relative terms such as "below", "beneath", "lower", "above", or "upper" may be used herein to describe one element's relationship to another element as illustrated in the Figures. It will be understood that spatially-relative terms are intended to encompass different orientations of the device in addition to the orientation depicted in the Figures. For example, if the device in one of the figures is turned over, elements described as "below" or "beneath" other elements would then be oriented "above" the other elements. The exemplary terms "below" or "beneath" can, therefore, encompass both an orientation of above and below. Since the device may be oriented in another direction, the spatially-relative terms may be interpreted in accordance with the orientation of the device.

The terminology used in the present disclosure is for the purpose of describing particular embodiments only and is not intended to limit the disclosure. As used in the disclosure and the appended claims, the singular forms "a", "an" and "the" are intended to include the plural forms as well, unless context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In the drawings, the thickness or size of each layer is exaggerated, omitted, or schematically illustrated for convenience of description and clarity. Also, the size or area of each constituent element does not entirely reflect the actual size thereof.

Hereinafter, exemplary embodiments of the present invention will be described with reference to the accompanying drawings.

FIG. 1 is a systematic diagram of a chiller including a general two-stage compressor.

As described above, referring to FIG. 1, the chiller 1 may include: a compressor 2 configured to compress a low-temperature and low-pressure refrigerant into a high-temperature and high-pressure refrigerant; a condenser 30 configured to condense the compressed high-temperature and high-pressure refrigerant into a liquid refrigerant; expanders 40 and 50 configured to decompress and expand the condensed liquid refrigerant; and an evaporator 60 configured to evaporate the liquid refrigerant to cool chilled water to be used by a demand source.

In order to improve compression efficiency, the compressor 2 may be formed as a two-stage compressor having a first compressor 10 and a second compressor 20. A chiller using such two-stage compressor may further include an economizer 70 configured to separate a refrigerant, having a mixture of two phases discharged from the first expander 40, into a gaseous phase and a liquid phase.

However, if the gaseous refrigerant flowing from the economizer 70 into the second compressor 20 hinders the flow of a refrigerant having passed through the first compressor 10, compression efficiency of the two-stage compressor 2 may be reduced.

A compressor according to FIGS. 2 to 8, which will be described below, is an example of a compressor including a first impeller housing and a diffuser for minimizing hindrance to the flow of the refrigerant having passed through the first compressor 10, which is caused by the gaseous refrigerant flowing from the economizer 70 into the second compressor 20.

In the following description, a first impeller refers to the first compressor 10; a second impeller refers to the second compressor 20; a first refrigerant refers to a refrigerant evaporated by passing through the evaporator 60; and a second refrigerant refers to a gaseous refrigerant separated by the economizer 70.

Figure 2A:
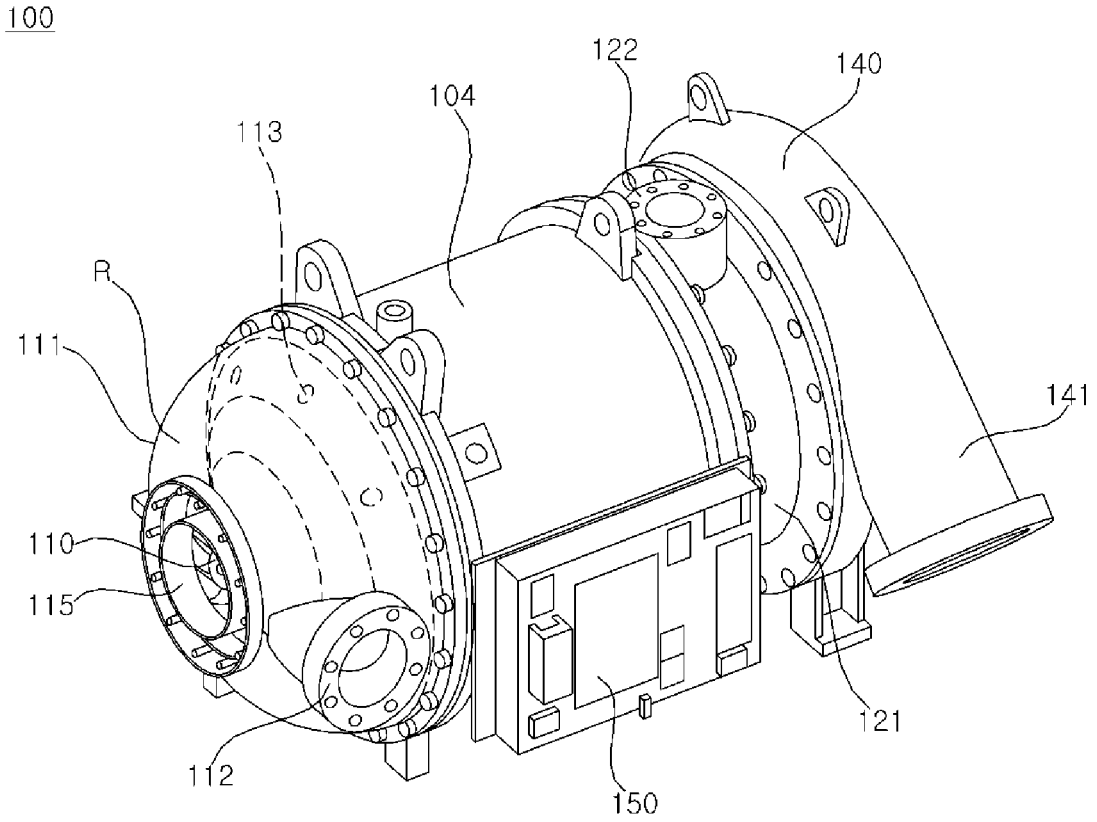
FIGS. 2A and 2B are diagrams illustrating the exterior of a compressor according to an embodiment of the present disclosure.
Figure 2B:
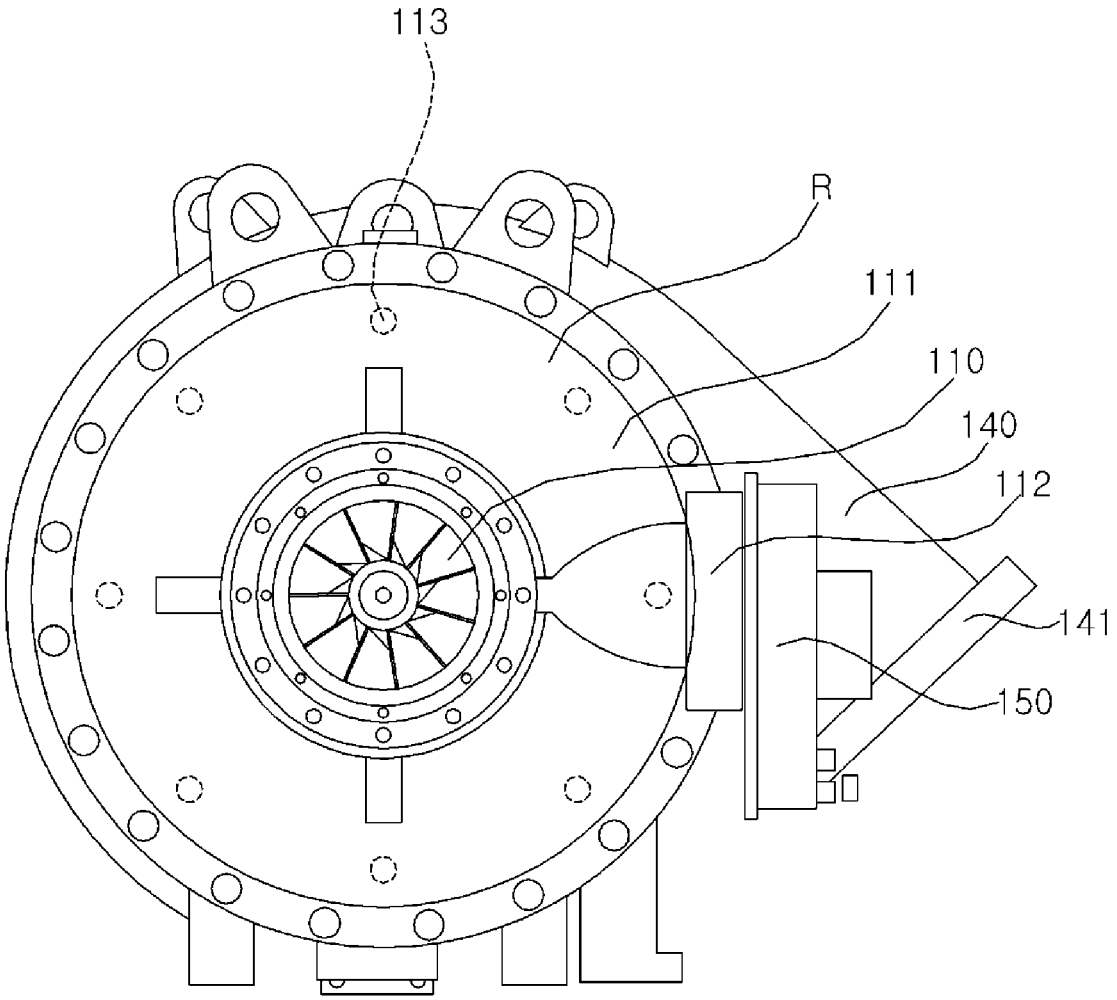

FIGS. 2A and 2B are diagrams illustrating an exterior of a compressor according to an embodiment of the present disclosure.

FIG. 2A is a perspective view of a compressor according to an embodiment of the present disclosure, and FIG. 2B is a front view of the compressor.

The compressor may compress gases, such as a refrigerant gas, and when an impeller is rotated by a driving force of a motor which is transmitted to the impeller, a gas may be introduced into the impeller by the torque of the impeller, and the gas flows by the impeller such that its kinetic energy increases, and the increased kinetic energy of the gas is converted into static pressure while the gas passes through a diffuser such that the pressure increases. The gas having increased pressure sequentially passes through a volute and a discharge port communicating with the volute, to be discharged outside of a centrifugal compressor.

Referring to FIGS. 2A and 2B, the exterior of the compressor 100 may include: a first impeller housing 111 forming a first inlet 115 and a chamber R; a first impeller 110 rotatably received in the first impeller housing 111; a motor housing 104 enclosing a rotor 102 and a stator 103; a second impeller housing 121 rotatably receiving the second impeller 120; a volute case 140 in which a volute (V) is formed; a discharge port 141 through which the compressed refrigerant is discharged to the condenser; and a bearing controller 150.

The first impeller housing 111 may have a second refrigerant inlet 112, through which the second refrigerant, discharged from the economizer 70, flows into the chamber R. The second refrigerant is separated by the economizer 70 and flows into the chamber R through the second refrigerant inlet 112, and may spread evenly in the chamber.

In the chamber R, the second refrigerant flows to a connecting passage 105 through a second refrigerant outlet 113, to be mixed with the first refrigerant compressed by the first impeller 110. The mixed refrigerant, having a mixture of the first refrigerant and the second refrigerant, may pass through the inside of the motor housing 104 and the second impeller housing 121, to flow into the condenser through the discharge port 141.

The flow of the refrigerant will be described in further detail later with reference to FIG. 5.

Figure 3:
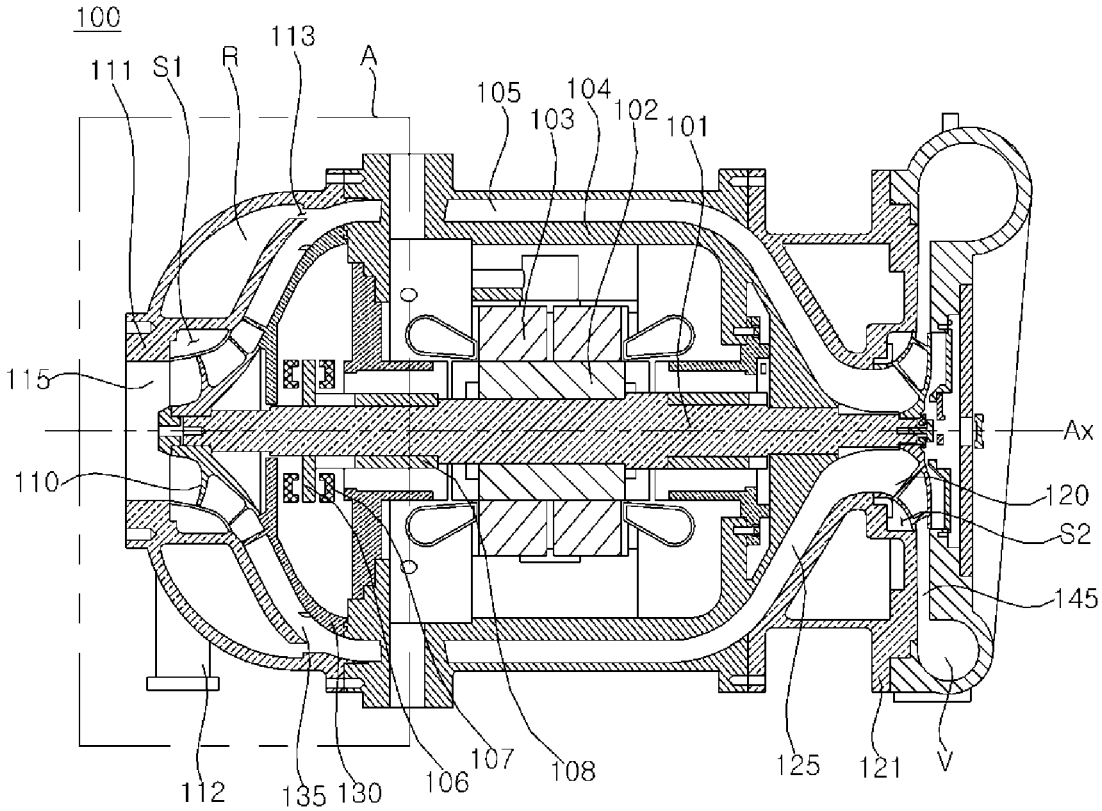
FIGS. 3 and 4 are cross-sectional views of a compressor according to an embodiment of the present disclosure.
Figure 4:
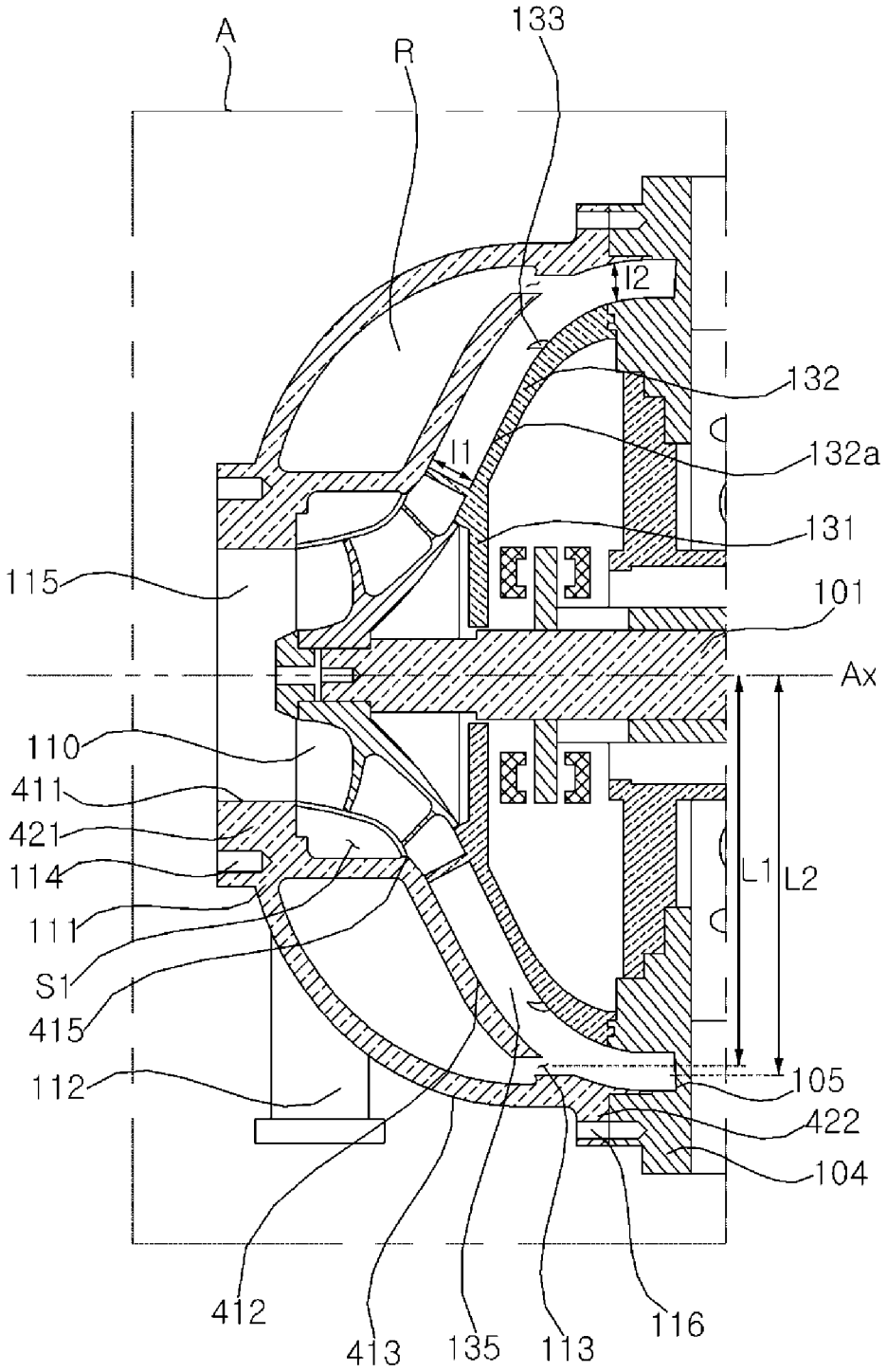

FIG. 3 is a cross-sectional view of a compressor according to an embodiment of the present disclosure, and FIG. 4 is an enlarged cross-sectional view of portion A shown in FIG. 3.

Referring to FIGS. 3 and 4, the compressor 100 may include: a motor M having a rotating shaft 101; a first impeller housing 111 forming a first inlet 115 and having a chamber R; a first impeller 110 coupled to one end of the rotating shaft 101 and rotatably received in the first impeller housing 111; a diffuser 130 being spaced apart from the inside of the first impeller housing 111; the second impeller housing 121 having a second inlet 125; a second impeller 120 coupled to the other end of the rotating shaft 101 and rotatably received in the second impeller housing 121; a volute case 140 in which a volute (V) is formed; a motor housing 104 having a connecting passage 105.

The motor M may have the rotating shaft 101 coupled with the first impeller 110 and the second impeller 120, a rotor 102 mounted on the rotating shaft 101, a stator 103 surrounding the rotor 102; and the motor housing 104. In the motor housing 104, the connecting passage 105 and a space for receiving the rotor 102 and the stator 103 may be formed.

The motor M may further include a gap sensor (not shown) for sensing a distance from the rotating shaft 101; a thrust bearing 107 for limiting vibration of the rotating shaft 101 in an axial direction Ax; and a plurality of journal bearings 108 supporting the rotating shaft 101 so that the rotating shaft 101 may rotate in the air.

The motor M may rotate the rotating shaft 101. The rotating shaft 101 is coupled with the first impeller 110 and the second impeller 120, and may extend in a left-right direction of FIG. 3. Hereinafter, the axial direction Ax of the rotating shaft 101 refers to the left-right direction, and an outward direction refers to the left direction of the axial direction Ax, and an inward direction refers to the right direction of the axial direction Ax.

The thrust bearing 107 may have a predetermined area on a plane perpendicular to the axial direction Ax, so as to prevent vibration of the rotating shaft 101 in the axial direction Ax (left-right direction).

Specifically, the rotating shaft 101 may further include a rotating shaft vane 106 which may move the rotating shaft 101 with a thrust force of the thrust bearing 107. The rotating shaft vane 106 may have an area wider than a cross-sectional area of the rotating shaft 101 on a plane perpendicular to the axial direction Ax. The rotating shaft vane 106 may extend in a rotation radial direction of the rotating shaft 101.

The thrust bearing 107 may restrict movement of the rotating shaft 101, which is caused by vibration in the axial direction Ax, and may prevent the rotating shaft 101 from colliding with other components of the compressor 100 as the rotating shaft 101 moves toward the first impeller 110 when surge occurs.

When the rotating shaft 101 rotates, the journal bearing 108 allows the rotating shaft 101 to rotate without friction while floating in the air. To this end, at least two or more journal bearings 108 may be provided around the rotating shaft 101.

A plurality of journal bearings 108 may be provided, which may be spaced apart from the rotating shaft 101 by a gap so as not to come into contact with the rotating shaft 101. That is, a first journal bearing and a second journal bearing may be spaced apart from each other around the rotating shaft 101.

The journal bearings 108 may be installed at least at two points of the rotating shaft 101. The two points are different points along a longitudinal direction of the rotating shaft 101. The rotating shaft 101 corresponds to a straight line, such that it is required to support the rotating shaft 101 at least at two points in order to prevent vibration in a circumferential direction.

In addition, the motor housing 104 may further include a first bearing housing (not shown) supporting the thrust bearing 107, and a second bearing housing (not shown) supporting the journal bearings 108.

The first impeller 110 may be coupled to one end of the rotating shaft 101, and when the rotating shaft 101 rotates, the first impeller 110 may rotate in a first impeller receiving space S1. The first impeller receiving space S1 may be formed inside the first impeller housing 111.

The first impeller 110 may suction and compress the first refrigerant. The first impeller 110 may suction the first refrigerant in the axial direction and may discharge the first refrigerant in a slope direction between the axial direction and the centrifugal direction. That is, the first impeller 110 may be a mixed flow type impeller.

The first impeller housing 111 may be composed of a first inner circumferential surface 411 forming the first inlet 115 and the first impeller receiving space S1, a second inner circumferential surface 412 facing the diffuser 130, and an outer circumferential surface 413 forming the exterior. The first refrigerant may flow from the evaporator 60 into the first impeller 110 through the first inlet 115.

The first impeller housing 111 may include hollow portions having different sizes. The hollow portions may refer to a space inwardly of the first inner circumferential surface 411. The first inlet 115 and the first impeller receiving space S1 may be formed in the space inwardly of the first inner circumferential surface 411. The first inlet 115 may be smaller in size than that of the first impeller receiving space S1.

The chamber R may be disposed inside the first impeller housing 111, and may be formed between the first inner circumferential surface 411, the second inner circumferential surface 412, and the outer circumferential surface 413. The chamber R may be separated from the first inlet 115 and the first impeller receiving space S1.

An outer diameter of the chamber R refers to a length from a rotating axis Ax to the outer circumferential surface of the chamber R. The outer circumferential surface of the chamber R refers to a circumferential surface of the chamber R facing the outer circumferential surface 413 of the first impeller housing 111. The outer diameter of the chamber R may gradually increase inwardly corresponding to the outer diameter of the first impeller housing 111.

A maximum outer diameter of the chamber R may be greater than an outer diameter of the connecting passage 105. Accordingly, the second refrigerant inside the chamber R may flow to the connecting passage 105, with minimal hindrance to the flow of the first refrigerant, through the second refrigerant outlet 113 which will be described later.

A size of the chamber R may correspond to a size of the first impeller housing 111.

An inner diameter of the first impeller housing 111 refers to a length from the rotating axis Ax to the first inner circumferential surface 411 or the second inner circumferential surface 412, and the outer diameter of the first impeller housing 111 refers to a length from the rotating axis Ax to the outer circumferential surface 414.

The outer diameter and the inner diameter of the first impeller housing 111 may increase in a flow direction of the first refrigerant. Specifically, the inner diameter of the first impeller housing 111 may increase stepwise, and the outer diameter of the first impeller housing 111 may increase gradually. As the inner diameter of the first impeller housing 111 increases stepwise, the first impeller receiving space S1, having a size different from that of the first inlet 115, may be formed. As the outer diameter of the first impeller housing 111 increases gradually, it is possible to minimize hindrance to the flow at a first outlet 135, which will be described later.

A rate of increase in the outer diameter of the first impeller housing 111 may be faster than a rate of increase in the inner diameter of the first impeller housing 111, from the one end 421 of the first impeller housing 111 to a boundary 415 of the first inner circumferential surface 411 and the second inner circumferential surface 412. Further, a rate of increase in the outer diameter of the first impeller housing 111 may be slower than a rate of increase in the inner diameter of the first impeller housing 111, from the boundary 415 of the first inner circumferential surface 411 and the second inner circumferential surface 412 to a distal end 422 of the first impeller housing 111.

That is, a distance between the first inner circumferential surface 411 and the outer circumferential surface 413 increases in a flow direction of the first refrigerant, and a distance between the second inner circumferential surface 412 and the outer circumferential surface 413 may decrease in the flow direction of the first refrigerant. Accordingly, a space surrounded by the first inner circumferential surface 411, the second inner circumferential surface 413, and the outer circumferential surface 413 may be formed inside the first impeller housing 111, and the chamber R may be formed in the space.

The first impeller housing 111 may further include a second refrigerant inlet 112 allowing a discharge tube of the economizer and the chamber R to communicate with each other, and a second refrigerant output 113 allowing the chamber R and the first outlet 135 to communicate with each other. The second refrigerant inlet 112 may allow the second refrigerant to flow from the economizer to the chamber R, and the second refrigerant outlet 113 may allow the second refrigerant to flow from the chamber R to the first outlet 135.

The second refrigerant inlet 112 may be connected to a front end of the chamber R in a direction perpendicular to the rotating axis Ax. The second refrigerant inlet 112 may be connected to an outer side of the outer circumferential surface of the chamber R. Accordingly, the second refrigerant, flowing through the second refrigerant inlet 112, may be evenly spread inside the chamber R.

A diameter of the second refrigerant inlet 112 may be greater than a diameter of the second refrigerant outlet 113. There are a plurality of second refrigerant outlets 113, and the diameter of the second refrigerant inlet 112 may vary according to the number of the second refrigerant outlets 113.

For example, if there are eight second refrigerant outlets 113, a cross-sectional area of the second refrigerant inlet 112 may be eight times greater than a cross-sectional area of the second refrigerant outlets 112. As the diameter of the second refrigerant inlet 112 varies according to the number of the second refrigerant outlets 113, the second refrigerant, which is evenly spread throughout the chamber R, may pass through the plurality of second refrigerant outlets 113 with a uniform speed and flow rate.

The second refrigerant outlets 113 may be connected to a rear end of the chamber R in a direction parallel to the rotating axis Ax. A distance between the rotating axis Ax and the second refrigerant outlet 113 may be within a predetermined distance from a distance between the rotating axis Ax and the connecting passage 105.

Referring to FIG. 4, a distance L1 between the rotating axis Ax and the center of the second refrigerant outlet 113 may be within a predetermined distance from a distance L2 between the rotating axis Ax and the center of the connecting passage 105. For example, the distance L1 from the rotating axis Ax to the center of the second refrigerant outlet 113 may be equal to the distance L2 from the rotating axis Ax to the center of the connecting passage 105. Accordingly, the second refrigerant, discharged through the second refrigerant outlet 113, may pass through the connecting passage 105 with a minimal decrease in flow rate.

The connecting passage 105 may be formed inside the motor housing 104. The connecting passage 105 may extend in the axial direction along the outer circumferential surface of the motor housing 104. The connecting passage 105 may provide a passage through which the mixed refrigerant, having a mixture of the first refrigerant and the second refrigerant, may pass.

The connecting passage 105 may connect the first outlet 135 and the second inlet 125. That is, the first refrigerant, compressed by the first impeller 110, may be discharged through the first outlet 135, and may be mixed with the second refrigerant introduced through the second refrigerant outlet 113, to flow to the second inlet 125 through the connecting passage 105.

The diffuser 130 may convert the kinetic energy of the first refrigerant into static pressure, and may be a vane diffuser in which a cross-sectional area of a passage, through which the first refrigerant passes, gradually decreases in the flow direction of the first refrigerant, and a plurality of vanes are installed at the passage.

The diffuser 130 may be disposed inside the first impeller housing 111, and may be mounted in the motor housing 104. A gap, through which the first refrigerant guided by the diffuser 130 may pass, may be formed between the diffuser 130 and the first impeller housing 111.

The diffuser 130 may include: a flat surface portion 131 having a hollow; an enlarging portion 132 having an outer diameter gradually increasing in a flow direction of the first refrigerant from the edge of the flat surface portion 131; and a diffuser vane 133 protruding outwardly from the enlarging portion 132.

The flat surface portion 131 may have a hollow, into which the rotating shaft 101 may be inserted. The flat surface portion 131 may be spaced apart from and opposite to an inner surface of the first impeller 110. A bearing may be mounted on the outside of the flat surface portion 131. That is, the bearing may be disposed between the flat surface portion 131 and the first impeller 110.

The enlarging portion 132 may be spaced apart from and opposite to the second inner circumferential surface 412. The enlarging portion 132 may have an outer diameter which increases in the flow direction of the first refrigerant so as to correspond to the second inner circumferential surface 412. The first outlet 135 may be formed between the enlarging portion 132 and the second inner circumferential surface 412. The first refrigerant, having passed through the first impeller 110, may flow to the connecting passage 105 through the first outlet 135.

A distance between the enlarging portion 132 and the second inner circumferential surface 412 may gradually decrease in the flow direction of the first refrigerant. A cross-sectional area at an entrance of the first outlet 135 may be greater than a cross-sectional area at an exit of the first outlet 135.

Referring to FIG. 4, a distance 11 between the enlarging portion 132 and the second inner circumferential surface 412 at the entrance of the first outlet 135 may be greater than a distance 12 between the enlarging portion 132 and the second inner circumferential surface 412 at the exit of the first outlet 135. Accordingly, the first outlet 135 may provide a passage allowing pressure of the first refrigerant to be recovered, while minimizing a decrease in pressure of the first refrigerant.

By the diffuser vane 133, pressure of the first refrigerant, compressed by the first impeller 110, may be recovered from a rotational kinetic energy. The diffuser vane 133 may protrude outwardly from a portion of the enlarging portion 132. There may be a plurality of diffuser vanes 133, which may be spaced apart from each other by a predetermined interval in a circumferential direction.

The second impeller housing 121 may form the second inlet 125 and a second impeller receiving space S2. The second inlet 125 may provide a passage, through which the mixed refrigerant having passed through the connecting passage 105 may flow into the second impeller 120. The second impeller 120 may be rotatably received in the second impeller receiving space S2.

The second impeller housing 121 may have an inner diameter which gradually decreases in a flow direction of the mixed refrigerant. The mixed refrigerant refers to a mixture of the first refrigerant, having passed through the first impeller 110, and the second refrigerant having passed through the chamber R. The mixed refrigerant may flow into the second inlet 125 through the connecting passage 105, and may be compressed by the second impeller 120.

The second impeller 120 may suction the mixed refrigerant in the axial direction and may discharge the mixed refrigerant in the centrifugal direction. That is, the second impeller 120 may be a centrifugal impeller. However, a type of the second impeller 120 is not limited to the centrifugal impeller.

The volute case 14 may be located at an innermost position of the compressor 100. The volute case 140 may have a second outlet 145 and a volute V. The second outlet 145 may provide a passage which is formed between the second impeller housing 121 and the volute case 140, and through which the mixed refrigerant discharged by the second impeller 120 passes. The mixed refrigerant, having passed through the second outlet 145, may be discharged to the discharge port 141 through the volute V.

Figure 5:
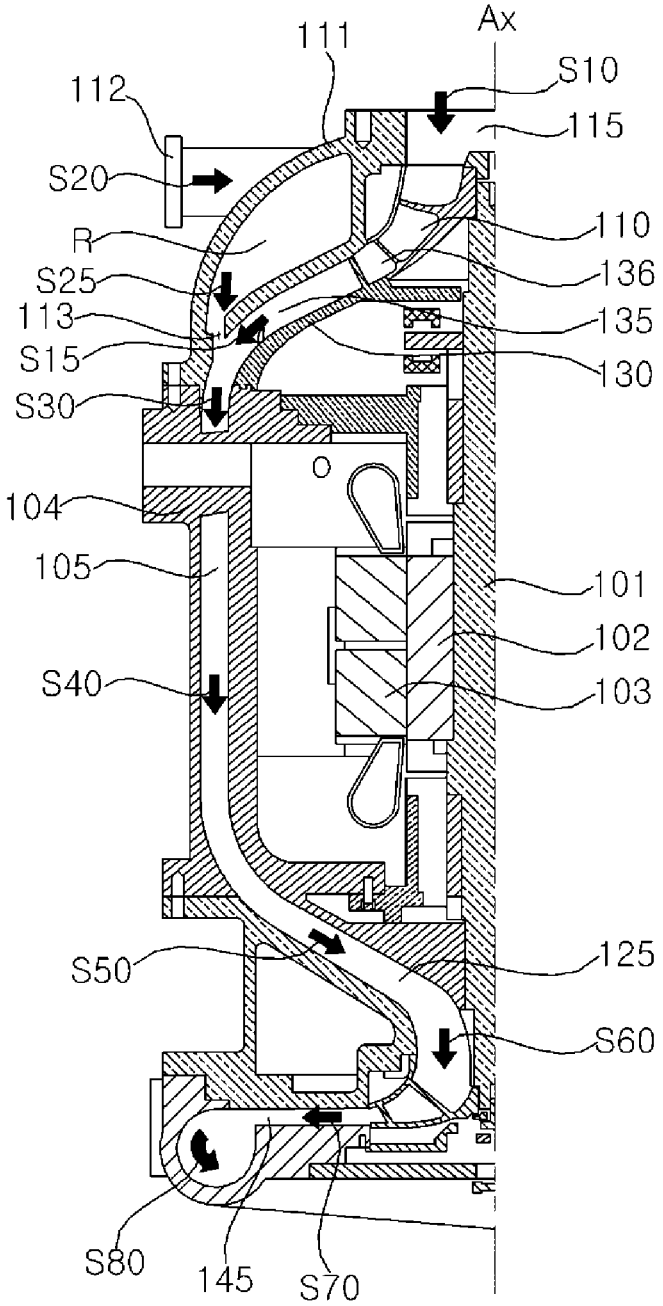
FIG. 5 is a diagram illustrating a flow of a refrigerant in a compressor according to an embodiment of the present disclosure.

FIG. 5 is a diagram illustrating a flow of a refrigerant in a compressor according to an embodiment of the present disclosure.

Referring to FIG. 5, a refrigerant may be compressed by the compressor 100 to be discharged to the condenser, and the refrigerant may include a first refrigerant separated into a liquid phase refrigerant, and a second refrigerant separated into a gaseous phase refrigerant.

The first refrigerant may flow into the compressor 100 through the first inlet 115 formed by the first impeller housing 111 (S10). The first refrigerant, flowing into the compressor 100, may be compressed by the first impeller 110, and may be discharged to the first outlet 135 through a first outlet entrance 136 (S15). The first impeller 110 may be a mixed flow type impeller, such that the first outlet 135 may provide a passage formed in a slope direction between the axial direction and the radial direction.

The second refrigerant may flow into the chamber R, formed inside the first impeller housing 111, through the second refrigerant inlet 112 (S20). The second refrigerant, which is uniformly spread throughout the chamber R, may be discharged to the first outlet 135 through the second refrigerant outlet 113 (S25). The second refrigerant outlet 113 may be disposed at a position further than the diffuser vane 133 in a radial direction. The diffuser vane 133 may be formed in the first outlet 135, and may guide the flow of the first refrigerant.

The second refrigerant may be mixed with the first refrigerant at a first outlet exit 137 (S30). The mixed refrigerant, having a mixture of the first refrigerant and the second refrigerant, may pass through the connecting passage 105 in the motor housing 104 (S40). The connecting passage 105 may extend axially outside of the rotor 102 and the stator 103 along an outer circumferential surface of the motor housing 104. The connecting passage 105 may connect the first outlet 135 and the second inlet 125.

The mixed refrigerant may pass through the connecting passage 105, to flow to the second inlet 125 formed by the second impeller housing 121 (S50). The mixed refrigerant, flowing to the second inlet 125, may flow to the second impeller 120 in the axial direction (S60), and may be discharged in the radial direction. The second impeller 120 may be a centrifugal impeller, and the compressor 100 may be a two-stage compressor having the first impeller 110 and the second impeller 120.

The mixed refrigerant compressed by the second impeller 120 may be discharged to the second outlet 145 formed between the volute case 140 and the second impeller housing 121 (S70). The second outlet may communicate with the volute V formed in the volute case 140. The mixed refrigerant may be discharged to the discharge port 141 through the volute V, to flow to the condenser.

To sum up, the first refrigerant may be introduced through the first inlet 115 to be compressed by the first impeller 110 in a single stage, and may be mixed with the second refrigerant, having passed through the chamber R, at the exit of the first outlet 135. The mixed refrigerant, having a mixture of the first refrigerant and the second refrigerant, may pass through the motor M through the connecting passage 105, and may pass through the second inlet 125 to be compressed by the second impeller 120 in two stages. As the mixed refrigerant, compressed in two stages, is discharged to the discharge port 141 through the second outlet 145 and the volute V, the compressor 100 may complete a two-stage compression process.

Figure 6:
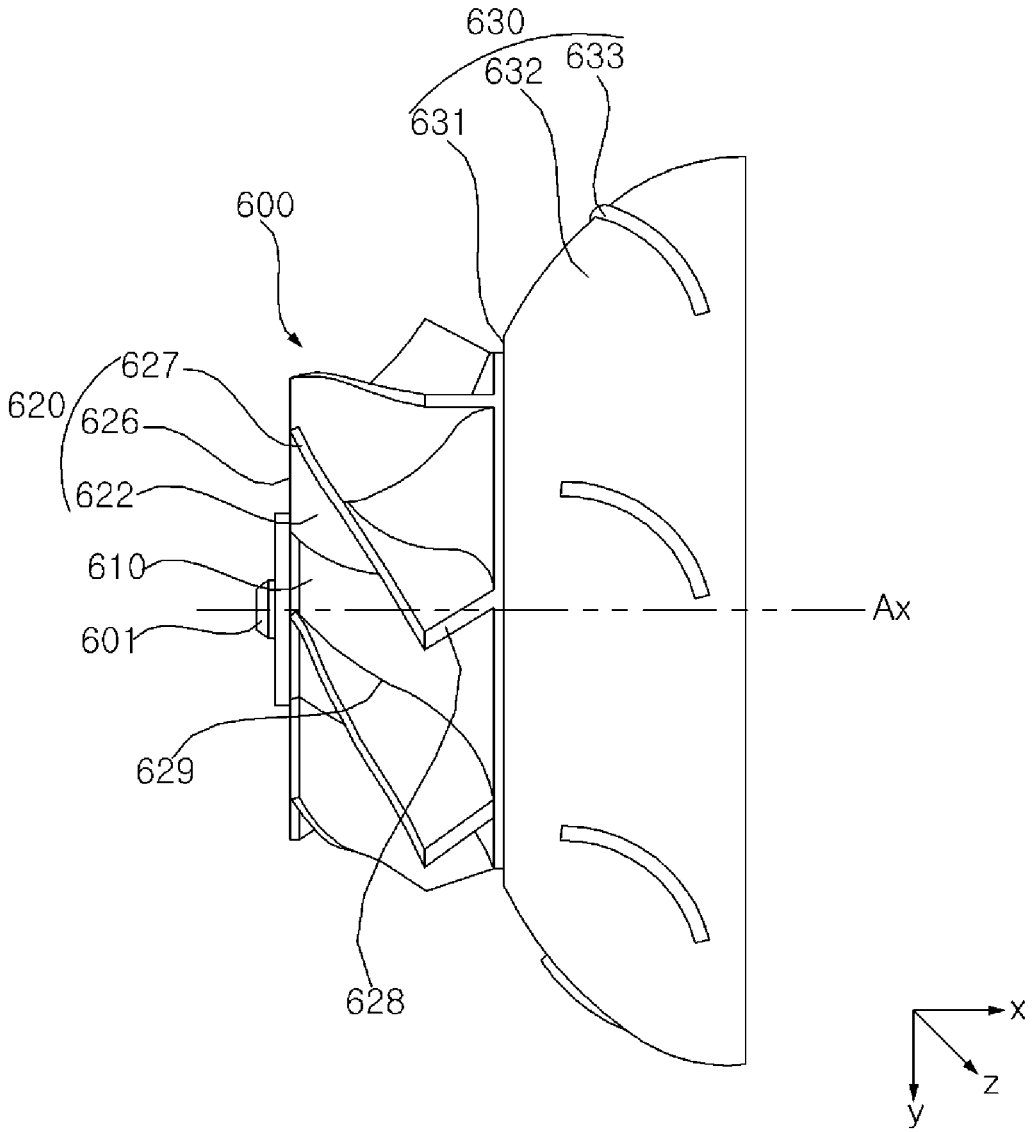
FIGS. 6 and 7 are diagrams illustrating a first impeller and a diffuser of a compressor according to an embodiment of the present disclosure.
Figure 7:
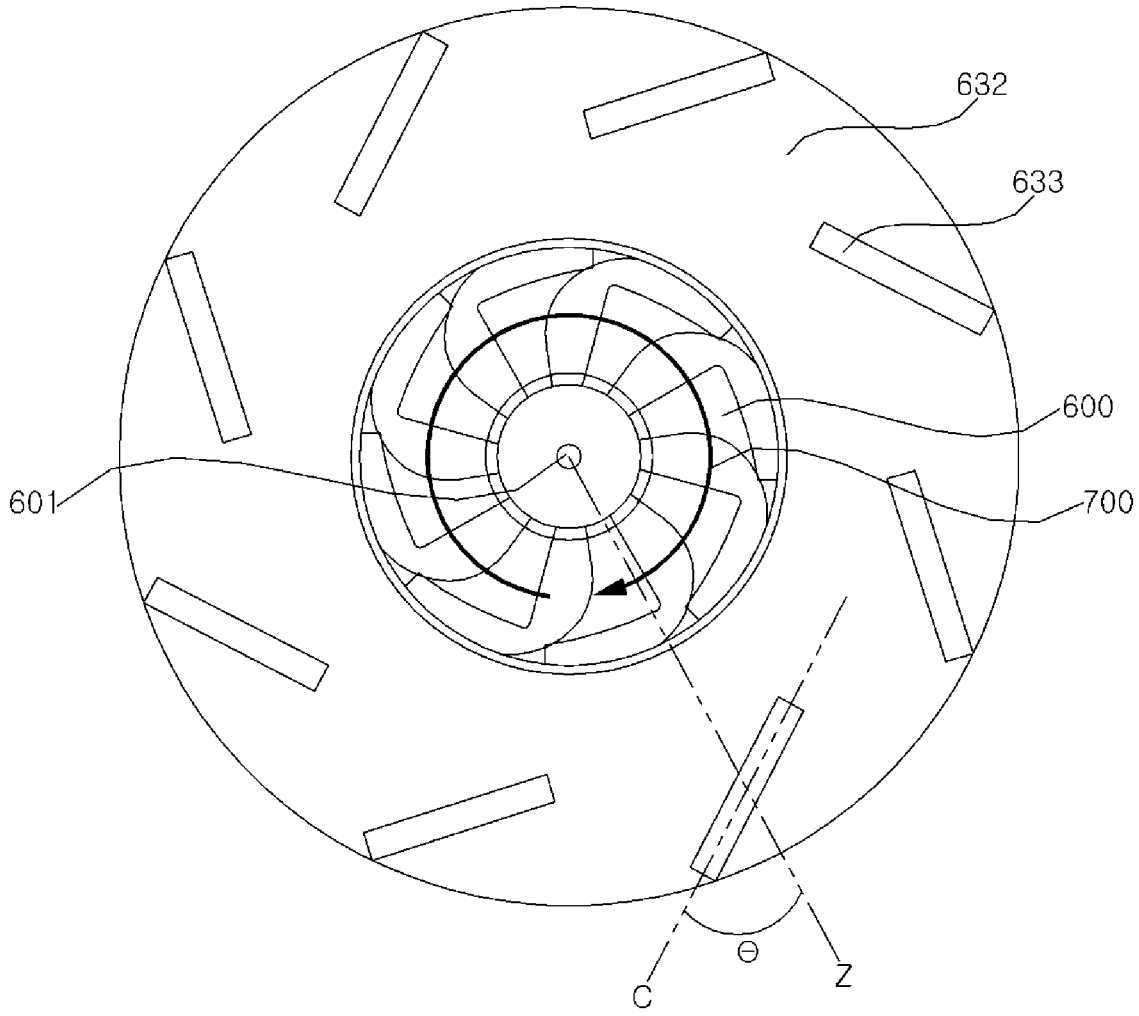

FIGS. 6 and 7 are diagrams illustrating a first impeller and a diffuser of a compressor according to an embodiment of the present disclosure.

FIG. 6 is an example of portion A shown in FIG. 3, and illustrates the exterior of a first impeller 600 and a diffuser 630 before the first impeller housing is mounted. FIG. 7 is a front view of FIG. 6.

Referring to FIG. 6, the first impeller 600 may be a mixed flow type impeller which suctions air in an axial direction and blows the air in a slope direction Z between an axial direction X and a centrifugal direction Y. Compared to an axial flow impeller or a centrifugal impeller, the mixed flow type impeller may minimize bending of the refrigerant and flow loss of the refrigerant.

Accordingly, the first outlet, through which the first refrigerant discharged by the first impeller 600 passes, may form a mixed flow passage guiding the refrigerant in the slope direction Z between the axial direction X and the centrifugal direction Y.

The first impeller 600 may include: a hub 610, having an inner surface facing a flat surface portion 631 of the diffuser 630; and a plurality of blades 620 spirally formed along an outer circumferential surface of the hub 610.

The inner surface of the hub 610 may be directed toward the diffuser 630, and an outer surface thereof may be directed toward the first inlet. An outer diameter of the hub 610 may gradually increase toward the diffuser 630.

The blade 620 may include a leading edge 626 and a trailing edge 628. The blade 620 may further include a blade tip 627 connecting the leading edge 626 and the trailing edge 628.

The blade tip 627 may be an outer end of the blade 620 in a centrifugal direction of the first impeller 600, and may be formed to connect a tip of the leading edge 626, which is located furthest from the hub 610, and a tip of the trailing edge 628 which is located furthest from the hub 610. The blade tip 627 may be formed in a three-dimensional (3D) shape. The blade tip 627 may be spaced apart from the first inner circumferential surface (e.g., 421 of FIG. 4) of the first impeller housing, so that a tip clearance may be formed therebetween.

The trailing edge 628 may be formed approximately perpendicular to a lower portion of the blade tip 627, and the blade tip 627 and the trailing edge 628 may also have an inclination angle which is an acute angle.

The blade 620 may include a boundary portion 629 connected to the hub 610, and the boundary portion 629 may be a portion at which the blade tip 627 has a different angle. That is, the blade 620 may be a 3D blade having a 3D shape.

In addition, the compressor may further include the diffuser 630 guiding the first refrigerant circulated by the first impeller 600. The refrigerant circulated by the first impeller 600 may be guided by the diffuser 630.

The diffuser 630 may be disposed inside the first impeller housing (e.g., 111 of FIG. 3). The diffuser 630 may be mounted in at least one of the motor housing (e.g., 104 of FIG. 3) or a motor bracket. A gap, through which the first refrigerant guided by the diffuser 630 may pass, may be formed between the diffuser 630 and the first impeller housing.

The diffuser 630 may include the flat surface portion 631 having a hollow, an enlarging portion 632 having an outer diameter which gradually increases in the flow direction of the first refrigerant from an edge of the flat surface portion 631; and the diffuser vane 633 protruding outwardly from the enlarging portion 632.

A portion of the diffuser 630 may face the first impeller 600, and a gap may be formed between one surface of the diffuser 630 and a surface of the first impeller 600 which faces the diffuser 630. Specifically, the flat surface portion 631 may face an inner surface of the first impeller 600, and a gap may be formed between an outer surface of the flat surface portion 631 and the inner surface of the first impeller 600. A bearing may be disposed in the gap.

The enlarging portion 632 may guide the refrigerant, blown by the first impeller 600 in the slope direction Z, to the second inner circumferential surface (e.g., 412 of FIG. 4) of the first impeller housing.

The outer diameter of the enlarging portion 632 may increase in the flow direction of the first refrigerant. The first outlet may be formed between the enlarging portion 632 and the second inner circumferential surface, and may communicate with the connecting passage (e.g., 105 of FIG. 3) in the motor housing.

The diffuser vane 633 may protrude outwardly from the enlarging portion 632. The diffuser vane 633 may protrude from the enlarging portion 632 so as to be disposed between the outer circumferential surface of the enlarging portion 632 and the second inner circumferential surface of the first impeller housing. The diffuser vane 633 may convert dynamic pressure of air, having passed through the first impeller 600, into static pressure.

A plurality of diffuser vanes 633 may be formed at the enlarging portion 632, and referring to FIG. 7, the respective diffuser vanes 633 may be spaced apart from each other at a predetermined interval in the circumferential direction. The interval may be determined on the basis of one end or the other end of the diffuser vane 633.

The diffuser vane 633, having a 3D shape, may extend along the outer circumferential surface of the enlarging portion 632. One end of the diffuser vane 633 may be directed toward the slope direction Z, and the other end of the diffuser vane 633 may be directed toward a predetermined acute angle in the rotation direction of the first impeller 600. That is, the diffuser vane 633 may extend in a curved shape, which is bent at a predetermined acute angle in the rotation direction of the first impeller 600.

In another embodiment, the diffuser vane 633 may be formed in a straight-line shape.

Referring to FIG. 7, the diffuser vane 633, having a straight-line shape, may be mounted in the enlarging portion 632. An axis C of the diffuser vane 633 may be twisted at a predetermined acute angle θ in a rotation direction 700 of the first impeller 600 relative to the slope direction Z. That is, the rotation direction 700 of the first impeller 600 is a right direction, and the diffuser vane 633 may be twisted to the right at the acute angle θ relative to the slope direction Z.

One end of the diffuser vane 633 may be spaced apart from the flat surface portion 631 by a predetermined distance, and the other end of the diffuser vane 633 may extend to a second refrigerant outlet (813 of FIG. 8) which will be described later.

The first refrigerant, having passed through the first impeller 600, may be guided along the enlarging portion 632 of the diffuser 630. The enlarging portion 632 may be spaced apart from the first impeller housing to form the first outlet (e.g., 135 of FIG. 3), through which the first refrigerant flows, along the outer circumferential surface of the enlarging portion 632. The first outlet may be a passage, through which the refrigerant discharged by the first impeller 600 in the slope direction Z may be diffused to be spread widely.

Pressure of the first refrigerant, passing through the first outlet, may be recovered by the diffuser vane 633, and the first refrigerant may flow to the connecting passage (e.g., 105 of FIG. 3) in the motor housing. The connecting passage may be a passage through which the refrigerant, having passed through the first outlet, passes through the motor (e.g., the rotor and stator) in a direction parallel to the rotating shaft 610.

Figure 8:
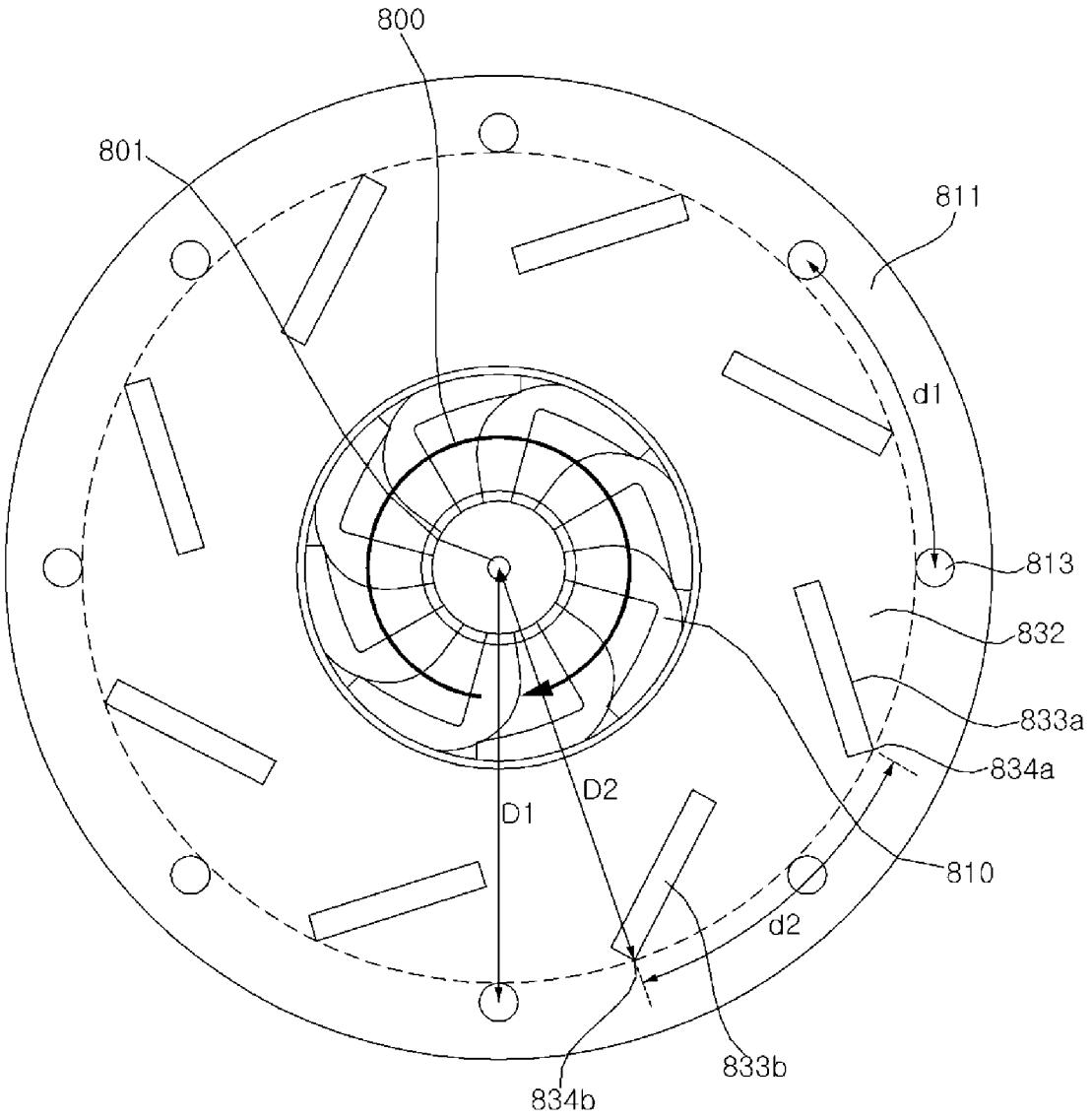
FIG. 8 is a diagram illustrating positions of second refrigerant outlets and diffuser vanes according to an embodiment of the present disclosure.

FIG. 8 is a diagram illustrating positions of a second refrigerant outlet and a diffuser vane according to an embodiment of the present disclosure.

FIG. 8 may be understood as an example in which a first impeller housing 811 is added to FIG. 7. Referring to FIG. 8, the first impeller 810 rotates to the right 800, and the first impeller housing 811 may include a second refrigerant outlet 813 which allows the chamber (e.g., R of FIG. 3) and the first outlet (e.g., 135 of FIG. 3) to communicate with each other.

The number of the second refrigerant outlets 813 may be equal to the number of the diffuser vanes 833. The second refrigerant outlets 813 may be radially spaced apart from each other by a predetermined interval. The diffuser vanes 833 may be radially spaced apart from each other by a predetermined interval. A spaced-apart interval d1 of the second refrigerant outlets 813 may be equal to a spaced-apart interval d2 of the diffuser vanes 833.

In this case, the spaced-apart interval d2 of the diffuser vanes 833 may be based on the other end of the diffuser vane 833. That is, the spaced-apart interval d2 of the diffuser vanes 833 may refer to a circumferential interval between the other end 834*a* of a first diffuser vane 833*a* and the other end 834*b* of a second diffuser vane 833*b*.

The second refrigerant outlet 813 may be disposed at a distance, equal to or greater than a distance from the rotating shaft 801 to the other end 834 of the diffuser vane 833, in the radial direction. Specifically, a distance from the rotating shaft 801 to the center of the second refrigerant outlet 813 may be equal to or longer than a distance from the rotating shaft 801 to the other end 834 of the diffuser vane 833.

If a distance D1 from the rotating shaft 801 to the center of the second refrigerant outlet 813 is shorter than a distance D2 from the rotating shaft 801 to the other end 834 of the diffuser vane 833, the second refrigerant discharged from the second refrigerant outlet 813 may hinder the flow of the first refrigerant, of which pressure is to be recovered by the diffuser vane 833.

The second refrigerant outlets 813 may be disposed between the respective diffuser vanes in the circumferential direction. Specifically, the second refrigerant outlets 813 may be disposed on a line bisecting the angle between the other end 834*a* of the first diffuser vane 833*a* and the other end 834*b* of the second diffuser vane 833*b*.

As the second refrigerant outlets 813 are disposed between the respective diffuser vanes 833 in the circumferential direction, it is possible to minimize hindrance to the flow of the first refrigerant flowing along the diffuser vanes 833, which is caused by the second refrigerant discharged from the second refrigerant outlets 813. That is, the first refrigerant and the second refrigerant may be mixed efficiently.

The present disclosure has one or more of the following effects.

First, by providing the chamber in the first impeller housing, the second refrigerant may be discharged at a uniform flow rate.

Second, by allowing the second refrigerant outlet to be positioned parallel to the connecting passage within a predetermined range, hindrance to the flow of the first refrigerant may be minimized.

Third, by alternately arranging the diffuser vanes and the second refrigerant outlets in the circumferential direction, it is possible to minimize hindrance to the flow of a refrigerant flowing to the second impeller, and to increase compression efficiency of the second impeller.

Fourth, by using the compressor according to the present disclosure, refrigeration efficiency may be improved.

The effects of the present disclosure are not limited to the aforesaid, and other effects not described herein will be clearly understood by those skilled in the art from the following description of the appended claims.

The above described features, configurations, effects, and the like are included in at least one of the embodiments of the present invention, and should not be limited to only one embodiment. In addition, the features, configurations, effects, and the like as illustrated in each embodiment may be implemented with regard to other embodiments as they are combined with one another or modified by those skilled in the art. Thus, content related to these combinations and modifications should be construed as including in the scope and spirit of the invention as disclosed in the accompanying claims.

What is claimed is:

1. A compressor, comprising:

a motor having a rotating shaft;

a first impeller housing forming a first inlet, through which a first refrigerant flows, and having a chamber into which a second refrigerant flows;

a first impeller coupled to one end of the rotating shaft, and rotatably received in the first impeller housing;

a diffuser spaced apart from an inside of the first impeller housing, and forming a first outlet;

a second impeller housing having a second inlet formed therein;

a second impeller coupled to the other end of the rotating shaft, and rotatably received in the second impeller housing;

a volute case in which a volute is formed; and a motor housing having a connecting passage formed therein and connecting the first outlet and the second inlet, wherein the first impeller housing has a first inner circumferential surface forming the first inlet and a receiving space of the first impeller, a second inner circumferential surface facing the diffuser, and an outer circumferential surface forming an exterior, wherein the diffuser comprises:

a flat surface portion having a hollow;

an enlarging portion having an outer diameter which gradually increases in a flow direction of the first refrigerant from an edge of the flat surface portion; and a diffuser vane protruding outwardly from the enlarging portion, wherein a distance between the enlarging portion and the second inner circumferential surface gradually decreases in the flow direction of the first refrigerant.

2. The compressor of claim 1, wherein the first impeller is a mixed flow type impeller which suctions the first refrigerant in an axial direction and discharges the first refrigerant in a slope direction between the axial direction and a centrifugal direction.

3. The compressor of claim 1, wherein the chamber is separated from the first inlet and the first impeller receiving space, between the first inner circumferential surface, the second inner circumferential surface, and the outer circumferential surface.

4. The compressor of claim 3, wherein a maximum outer diameter of the chamber is greater than an outer diameter of the connecting passage.

5. The compressor of claim 3, wherein the first impeller housing has an outer diameter and an inner diameter which increase in a flow direction of the first refrigerant.

6. The compressor of claim 5, wherein a rate of increase in the outer diameter:

with respect to an axial direction is faster than a rate of increase in the inner diameter with respect to the axial direction, and wherein a positive axial direction is from the first impeller towards the second impeller.

7. The compressor of claim 5, wherein the first impeller housing further comprises:

a second refrigerant inlet allowing a discharge tube of an economizer to communicate with the chamber so that the second refrigerant flows into the chamber; and a second refrigerant outlet allowing the chamber to communicate with the first outlet.

8. The compressor of claim 7, wherein:

the second refrigerant inlet is connected to a front end of the chamber in a direction perpendicular to the rotating shaft; and a diameter of the second refrigerant inlet is greater than a diameter of the second refrigerant outlet.

9. The compressor of claim 7, wherein:

the second refrigerant outlet is connected to a rear end of the chamber in a direction parallel to the rotating shaft; and a distance between the rotating shaft to the second refrigerant outlet is within a predetermined distance from a distance between the rotating shaft and the connecting passage.

10. The compressor of claim 9, wherein the connecting passage provides a passage through which a mixed refrigerant having a mixture of the first refrigerant and the second refrigerant passes, and extends axially along an outer circumferential surface of the motor housing.

11. The compressor of claim 1, wherein the enlarging portion is spaced apart from the second inner circumferential surface, so that the first outlet is formed between the enlarging portion and the second inner circumferential surface.

12. The compressor of claim 1, wherein a plurality of diffuser vanes is formed while forming an acute angle with a slope direction of the enlarging portion, and wherein the respective diffuser vanes are spaced apart from each other at a predetermined interval in a circumferential direction.

13. The compressor of claim 12, wherein the first impeller housing further comprises second refrigerant outlets allowing the chamber to communicate with the first outlet, wherein a number of the diffuser vanes is equal to a number of the second refrigerant outlets.

14. The compressor of claim 13, wherein the second refrigerant outlets:

are disposed at a distance equal to or greater than a distance from the rotating shaft to one end of the diffuser vanes in a radial direction; and are disposed between the respective diffuser vanes in the circumferential direction.

15. The compressor of claim 1, wherein the second impeller housing has an inner diameter which gradually decreases in a flow direction of the mixed refrigerant having the mixture of the first refrigerant and the second refrigerant.

16. The compressor of claim 15, wherein the second impeller is a centrifugal impeller which suctions the mixed refrigerant in an axial direction and discharges the refrigerant in a centrifugal direction.

17. The compressor of claim 16, wherein the volute case forms a second outlet which is formed between the second impeller hosing and the volute case, and through which the mixed refrigerant discharged by the second impeller passes.

18. A chiller, comprising:

a compressor;

a condenser configured to condense a refrigerant compressed by the compressor;

a first expander configured to expand the condensed refrigerant;

an economizer configured to separate the expanded refrigerant into a first refrigerant in a gaseous state and a second refrigerant in a liquid state, and to flow the first refrigerant into the compressor;

a second expander configured to expand the second refrigerant; and an evaporator configured to evaporate the expanded second refrigerant, wherein the compressor comprises:

a motor having a rotating shaft;

a first impeller housing forming a first inlet, through which the first refrigerant flows, and having a chamber into which the second refrigerant flows;

a first impeller coupled to one end of the rotating shaft, and rotatably received in the first impeller housing;

a diffuser spaced apart from an inside of the first impeller housing, and forming a first outlet;

a second impeller housing having a second inlet formed therein;

a second impeller coupled to the other end of the rotating shaft, and rotatably received in the second impeller housing;

a volute case in which a volute is formed; and a motor housing having a connecting passage formed therein and connecting the first outlet and the second inlet, wherein the first impeller housing has a first inner circumferential surface forming the first inlet and a receiving space of the first impeller, a second inner circumferential surface facing the diffuser, and an outer circumferential surface forming an exterior, wherein the diffuser comprises:

a flat surface portion having a hollow;

an enlarging portion having an outer diameter which gradually increases in a flow direction of the first refrigerant from an edge of the flat surface portion; and a diffuser vane protruding outwardly from the enlarging portion, wherein a distance between the enlarging portion and the second inner circumferential surface gradually decreases in the flow direction of the first refrigerant.

* * * * *